United States Patent [19]

Vigneron et al.

[11] Patent Number: 4,763,449

[45] Date of Patent: Aug. 16, 1988

[54] MANHOLE COVER SEALING AND LOCKING ARRANGEMENT

[75] Inventors: Pierre Vigneron, Pont-A-Mousson; Jean-Claude Hauer, Saulxures Les Nancy, both of France

[73] Assignee: Pont-A-Mousson S.A., Nancy, France

[21] Appl. No.: 110,623

[22] Filed: Oct. 20, 1987

Related U.S. Application Data

[63] Continuation of Ser. No. 854,957, Apr. 22, 1986, abandoned.

[30] Foreign Application Priority Data

Apr. 29, 1985 [FR] France ..... 85 07052

[51] Int. Cl.[4] ..... E02D 29/14

[52] U.S. Cl. ..... 52/20; 404/25; 220/301

[58] Field of Search ..... 52/20; 404/25, 26; 220/301

[56] References Cited

U.S. PATENT DOCUMENTS

| | | | |
|---|---|---|---|
| 175,725 | 4/1876 | Mecklenberg | 404/25 |
| 794,661 | 7/1905 | Clark | 404/25 |
| 1,384,712 | 7/1921 | Shanley | 52/20 |
| 3,102,660 | 9/1963 | Bowden | 220/301 |
| 4,203,686 | 5/1980 | Bowman | 52/20 |

FOREIGN PATENT DOCUMENTS

| | | | |
|---|---|---|---|
| 1426805 | 12/1965 | France . | |
| 2153823 | 5/1973 | France . | |
| 1515278 | 6/1978 | United Kingdom | 52/20 |
| 2092649 | 8/1982 | United Kingdom | 52/20 |
| 2102479 | 2/1983 | United Kingdom | 52/20 |

*Primary Examiner*—Carl D. Friedman
*Assistant Examiner*—Caroline D. Dennison
*Attorney, Agent, or Firm*—Sughrue, Mion, Zinn, Macpeak & Seas

[57] ABSTRACT

A manhole for an urban sanitary system comprises a cover 2, a frame 1 for receiving the cover, a toric elastomeric sealing ring G1 interposed between the frame and the cover, and a soundproofing ring G2 on which the cover seats. The locking of the cover on the frame and the support of the cover on the rings G1and G2 are implemented by a plurality of flanges 4 recessed in the frame and bolted thereto.

9 Claims, 3 Drawing Sheets

MANHOLE COVER SEALING AND LOCKING ARRANGEMENT

This is a continuation of application Ser. No. 854,957, filed Apr. 22, 1986, abandoned.

BACKGROUND OF THE INVENTION

This invention relates to a manhole with a locked and sealed cover enabling access to an underground system, in particular an underground urban sanitary system.

It is known that such a manhole must be sealed in order to prevent the penetration of run-off water into the system. In addition the cover must be held firmly in its frame in order to prevent the movement of the cover during the passage of a vehicle. These two problems of sealing and holding are particularly crucial in hilly or mountainous regions due to the large potential quantities of run-off water and the high mechanical stresses caused by vehicles on an uphill or downhill road.

French Pat. 1,426,805 describes a manhole of a generally circular shape which is sealably locked and which comprises a cover, or plug, held in a frame by a locking device taking support on the lower surface of the frame and connected to a threaded stem traversing the plug from side to side, with a sealing ring being interposed between the frame and the cover. In this device the threaded stem which ensures the application of the locking device on the lower surface of the frame is situated at a distance from the center of the cover which is less than the radius of the sealing ring interposed between the frame and the cover. In such a device there is thus a problem of sealing the passage of the threaded stem through the cover, which cannot be resolved by a toric joint due to the stresses received by the cover during the passage of vehicles.

In addition, the locking of the cover on its frame is provided by direct contact, metal against metal, between the frame and the cover. However, in view of the foundry manufacturing tolerances, perfect contact over the entire periphery of the cover is difficult to provide. Thus, the inevitable results are movements between the cover and the frame which, on the one hand, create unacceptable noises when a vehicle passes over the manhole and, on the other hand, cause the shearing of the sealing ring.

U.S. Pat. No. 4,203,686 is also known which describes an obturation device comprising a cover held in a frame by a locking ring applied on the upper surface of the cover and which has support surfaces opposite corresponding surfaces of the frame which cooperate therewith to apply the cover on the frame when the locking ring is rotated. A sealing ring is interposed between the frame and the cover. With such a device the locking of the cover is achieved without any perforations of the cover and there is therefore no additional sealing problem. However, since the locking is simply done by rotating the locking ring and is maintained by friction, the repeated passage of vehicles can cause the inverse rotation of the locking ring, which unlocks the cover. The friction coefficient between the metallic components is such that the forces caused by such friction and opposing the rotation of the locking ring are negligible in relation to the forces caused by the passage of a vehicular load on the manhole.

SUMMARY OF THE INVENTION

An object of the invention is to overcome these disadvantages by providing a sealed locking device for a cover on its frame, while at the same time maintaining the sealing of the manhole by totally preventing any up or down vertical movement of the cover in the frame following the passage of vehicles.

The manhole in accordance with the invention comprises a cover, a frame for receiving the cover, a compressible sealing ring interposed between the frame and the cover, and a plurality of clamping flanges for locking the cover on the frame and against an incompressible soundproofing ring also interposed between the frame and the cover.

DETAILED DESCRIPTION OF THE PREFERRED EMBODIMENTS

Figure 1:
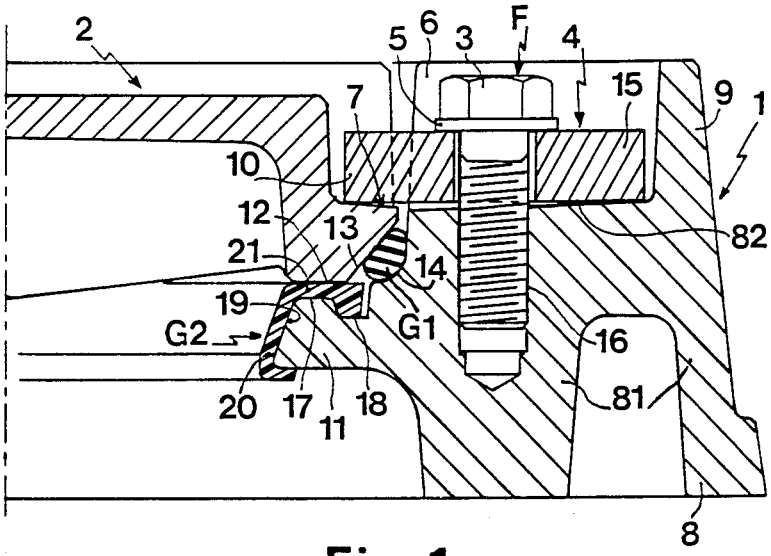
FIG. 1 is a partial cross-section of a locked, sealed manhole in accordance with the invention taken on a vertical radial plane through a clamping flange.

As shown in FIG. 1, the manhole comprises a cover 2, a frame 1 to receive the plug, a toric elastomeric sealing ring G1 having a hardness of between 45° and 60° SHORE A interposed between the frame and the plug, a soundproofing ring G2 having a hardness of between 41° and 46° SHORE D (which can be of a known type as described in French Pat. No. 2,153,823), and a plurality of clamping flanges 4 removably bolted to the frame. In a preferred embodiment the manhole is circular in shape, but it could, for example, be triangular or rectangular.

Figure 2:
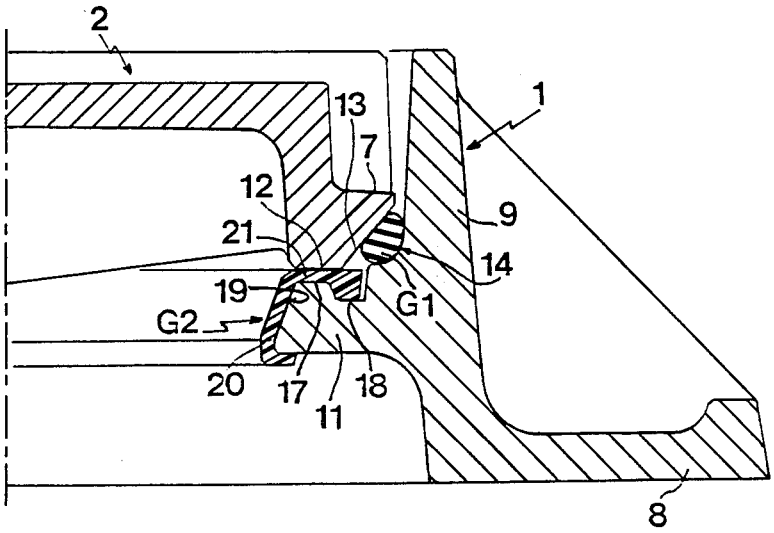
FIG. 2 is a partial cross-section of the locked, sealed manhole of FIG. 1 taken on a vertical radial plane situated between two clamping flanges.

As illustrated in FIGS. 1 and 2, the frame 1 comprises a continuous skirt 9 extending vertically from a horizontal support plate 8 by means of which the frame takes support on the top of a shaft (not shown) constituting an access and inspection hole.

At approximately the middle of skirt 9 there is an internal radial flange 11 whose upper part 17 is slightly inclined to the horizontal and which is extended externally by a peripheral groove 18. The flange 11 has an interior truncated surface 19. The flange is connected by a fillet 14 above the groove 18 to skirt 9. The fillet acts as a seat for the sealing ring G1.

The support plate 8 of frame 1 has a plurality of integral and upstanding reliefs 81 evenly distributed around its periphery. These reliefs have an upper truncated support surface 82 slightly inclined to the horizontal, with the internal limit of the support surface being at a lower height than its external limit. In a preferred embodiment there are six such reliefs 81, and they are intermediate the surface 17 of flange 11 and the skirt 9 to thus define a plurality of housing recesses 6. The upper surfaces 82 of the reliefs have tapped bores 16.

Figure 4:
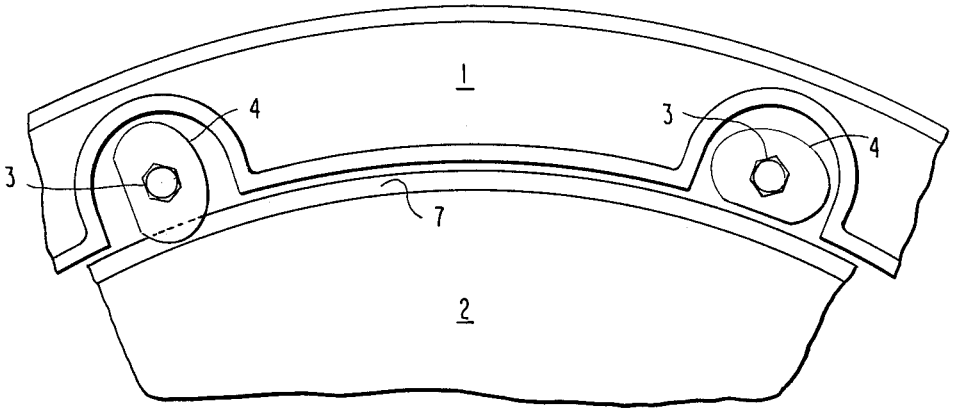
FIG. 4 is a partial plan view of the manhole showing two clamping flanges in engaged and disengaged positions.

Each clamping flange 4 has an internal portion 10, an external portion 15, and a central hole for the passage of a bolt 3 carrying a washer 5 to fix the flange on the frame. Bolts 3 and washers 5 constitute the fixing means designated by reference character F. Each external portion 15 of a flange 4 is supported on the surface 82 of a relief inside a recess 6, there being the same number of flanges as recesses. The clamping flanges are generally circular or oval in shape with a chord like flattening on one side, and are dimensioned such that they are rotatable about the loosened bolts within the recesses 6. The flattened sides may thus be oriented radially inwardly to permit the removal of the cover without having to fully remove the flanges, as illustrated for the clamping flange on the right side of FIG. 4.

The cover 2 has a peripheral shoulder 7 for supporting the internal portion 10 of the flanges, such shoulder being slightly inclined to the horizontal as shown. The shoulder 7 is connected to a lower support surface 12 by a truncated surface 13.

Sealing ring G1 is disposed between the fillet 14 and the truncated cover surface 13. Soundproofing ring G2 interposed between the frame flange 11 and the cover is composed of a material which is resistant to any compression which may result from the passage of a vehicle over the manhole, such as polyethylene. Ring G2 has an inverted G-shaped profile and envelops the radial flange 11. It comprises a body 20 with an external profile corresponding to that of the truncated surface 19 of flange 11, connected to two horizontal lips, the upper lip 21 of which has an internal profile corresponding to that of flange surface 17. This upper lip 21 ends in a connecting bead seating in groove 18. The cover 2 rests on the soundproofing ring G2.

The diameter of the hole in flange 4 for the passage of bolt 3 is greater than the diameter of the bolt to allow for manufacturing tolerances and to enable slight angular deviations of the bolt axis. Such accommodation of the manufacturing tolerances of foundry cast components is also implemented by the inclinations of the surfaces 82 and 7 such that the portions 10 and 15 of each flange 4 are always in contact with their support surfaces 7 and 82.

During assembly the application of flanges 4 against the support surfaces 7 and 82 of the cover and the frame, by tightening bolts 3, compresses the sealing ring G1 between the cover surface 13 and the frame fillet 14 until surface 12 of the cover comes into contact with the incompressible ring G2. After that any further tightening becomes practically impossible since the soundproofing ring G2 is substantially incompressible. The cover and the frame are thus never in direct metal-to-metal contact, and the cover is perfectly locked since it cannot move vertically due to the clamping flanges 4 and the ring G2. Sealing is provided by the compression of ring G1.

The amount of compression of ring G1 is a function of the molding tolerances of the foundry cast components, which is why ring G1 is composed of an elastomer with a hardness of between 45° and 60° SHORE A to provide easy compression even in the case of extreme variations which would decrease the volume between fillet 14 and surface 13 when surface 12 of the cover contacts lip 21 of the incompressible ring G2.

In addition, once the manhole is assembled, since all vertical movement of the cover is prevented by the flanges 4 and the ring G2, ring G1 is not subjected to any increased compression and therefore does not prematurely deteriorate.

Figure 3:
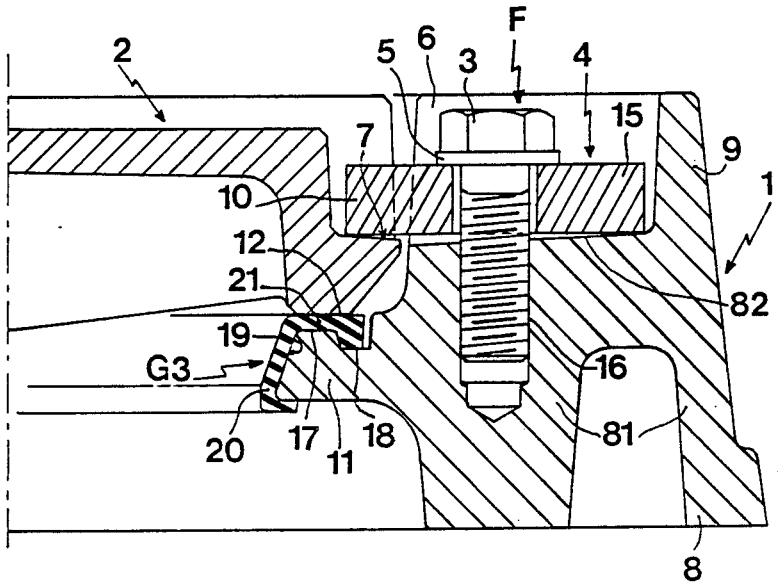
FIG. 3 is a cross-section analogous to that of FIG. 1 of an alternate embodiment.

In the alternate embodiment shown in FIG. 3, the sealing ring G1 has been removed and the soundproofing ring G2 has been replaced by a sealing ring G3 which has the same profile as the ring G2 but which is composed of a compressible material with an intermediate hardness, for example an elastomer with a hardness of 60° SHORE A. With this embodiment the clamping flange bolts 3 are tightened by a torque wrench or the like to apply a given preconstraint to the ring G3 which corresponds to the passage of a thirteen ton load over the manhole. This preconstraint prevents any sinking of the cover in relation to the frame during the passage of a vehicle, which would otherwise cause the loosening of the bolts and clamping flanges. Ring G3 thus serves both to seal the manhole against run-off water and to lock the cover, since the ring is preconstrained during the assembly of the manhole and any subsequent movement of the cover is rendered impossible. It is obvious that the elastomeric ring G3 could have another profile, such as, for example, that described in French Pat. No. 2,508,953, provided that the ring is compressible and is interposed between a lower support surface of the cover and an upper support surface of the frame, with the frame and cover never being in direct metal-to-metal contact.

What is claimed is:

1. A manhole assembly comprising, in combination:

(a) a centrally apertured frame member (1) upstanding from a base plate (8) and defining a radially inwardly extending support flange (11), (b) a cover member (2) seated on said support flange for closing said aperture, (c) a compressible sealing ring (G1; G3) interposed between the frame member and the cover member, (d) a plurality of independent and individual clamping flanges (4) separate and distinct from the frame member and evenly distributed around a periphery thereof, each clamping flange having a generally central aperture, a clamping edge (10) extending radially outwardly from said aperture a first distance and adapted to overhang the frame member support flange and bear directly against the cover member when the clamping flange is in a first position, and a flattened edge angularly displaced from the clamping edge, extending radially outwardly from the aperture a second distance shorter than the first distance, and adapted to lie clear of the cover member when the clamping flange is in a second position, and (e) an equal plurality of fixing means (3) separate and distinct from the frame member for individually securing the clamping flanges to the frame member via the apertures such that the clamping flanges may be locked in said first position whereat they bear vertically downwardly against the cover member to urge the cover member against the support flange and thereby prevent any vertical movement of the cover member upon the passage of vehicles over the manhole assembly, and wherein the fixing means may be loosened to unlock the clamping flanges and enable their rotation to said second position whereat the cover member is removable from the frame member without necessitating the removal of the fixing means and the clamping flanges.

2. The manhole assembly according to claim 1, wherein the frame member comprises a continuous skirt (9) surrounding the cover member, and a plurality of reliefs (81) integral with the base plate and having upper support surfaces (82) surrounded externally by said skirt and disposed in recesses (6) evenly distributed around the periphery of the frame member, the clamping flanges being disposed in said recesses and bearing against and being secured to said upper support surfaces.

3. The manhole assembly according to claim 2, wherein the overhanging portion of each clamping flange bears against a peripheral shoulder (7) extending radially outwardly from a side face of the cover member.

4. The manhole assembly according to claim 3, wherein the fixing means comprises bolts passing through said central apertures in each clamping flange, each bolt being screwed into a tapped bore (16) in the upper support surface of a relief.

5. The manhole assembly in accordance with claim 4, wherein the aperture in each clamping flange has a greater diameter than the bolt.

6. The manhole assembly in accordance with claim 3, wherein the upper support surface of each relief and the shoulder of the cover member are downwardly inclined towards each other in relation to the horizontal.

7. The manhole assembly in accordance with claim 1, further comprising a ring (G2) with a hardness of be-between 41° and 46° SHORE D interposed between the support flange and the cover member.

8. The manhole assembly in accordance with claim 1, wherein the sealing ring (G3) is interposed between the support flange and the cover member, and is compressed to a predetermined level by tightening the fixing means.

9. The manhole assembly in accordance with claim 1, wherein each clamping flange is one of circular and oval in shape, with a chord-like flattening on one side.

* * * * *